US010103462B1

(12) United States Patent
Herring et al.

(10) Patent No.: US 10,103,462 B1
(45) Date of Patent: Oct. 16, 2018

(54) CARD-EDGE CONNECTOR ASSEMBLY HAVING CARD GUIDE MODULES

(71) Applicant: TE CONNECTIVITY CORPORATION, Berwyn, PA (US)

(72) Inventors: Michael David Herring, Apex, NC (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/490,217

(22) Filed: Apr. 18, 2017

(51) Int. Cl.

| | |
|---|---|
| ***H01R 13/62*** | (2006.01) |
| ***H01R 12/70*** | (2011.01) |
| ***H01R 12/73*** | (2011.01) |
| ***H01R 12/72*** | (2011.01) |
| ***H01R 12/91*** | (2011.01) |

(52) U.S. Cl.
CPC ..... *H01R 12/7005* (2013.01); *H01R 12/7047* (2013.01); *H01R 12/721* (2013.01); *H01R 12/737* (2013.01); *H01R 12/91* (2013.01)

(58) Field of Classification Search
CPC ..... H01R 12/72; H01R 12/721; H01R 12/83; H01R 12/7005; H01R 12/7047; H01R 12/737; H01R 12/91; H01R 13/62; H01R 13/6275
USPC ..... 439/325, 327, 328
See application file for complete search history.

(56) References Cited

U.S. PATENT DOCUMENTS

| | | | | |
|---|---|---|---|---|
| 3,932,016 | A | 1/1976 | Ammenheuser | |
| 5,829,601 | A * | 11/1998 | Yurchenco | H05K 7/1418 211/41.17 |
| 5,980,299 | A | 11/1999 | Davis | |
| 6,045,385 | A | 4/2000 | Kane | |
| 6,083,026 | A | 7/2000 | Trout et al. | |
| 6,160,706 | A * | 12/2000 | Davis | H01R 12/7029 361/704 |
| 6,168,450 | B1 * | 1/2001 | Davis | H05K 7/1431 439/325 |
| 6,227,898 | B1 * | 5/2001 | Meng | H01R 13/645 439/374 |
| 6,331,940 | B1 * | 12/2001 | Lin | H05K 7/1431 361/785 |
| 8,475,195 | B2 | 7/2013 | Annis et al. | |
| 2008/0096412 | A1 * | 4/2008 | Poh | H01R 13/645 439/326 |

* cited by examiner

*Primary Examiner* — Chandrika Prasad

(57) ABSTRACT

A card edge connector assembly includes a card edge connector having a housing defining a card slot for a circuit card and having a base mounted to a host circuit board and including mounting lugs having datum surfaces. The assembly includes card guide modules coupled to the housing each having a base secured to the host circuit board and a support beam extending from the base for supporting the circuit card. The base includes a locating cavity that receives the mounting lug and locating surfaces that engage the datum surfaces to register the card guide modules relative to the housing.

20 Claims, 4 Drawing Sheets

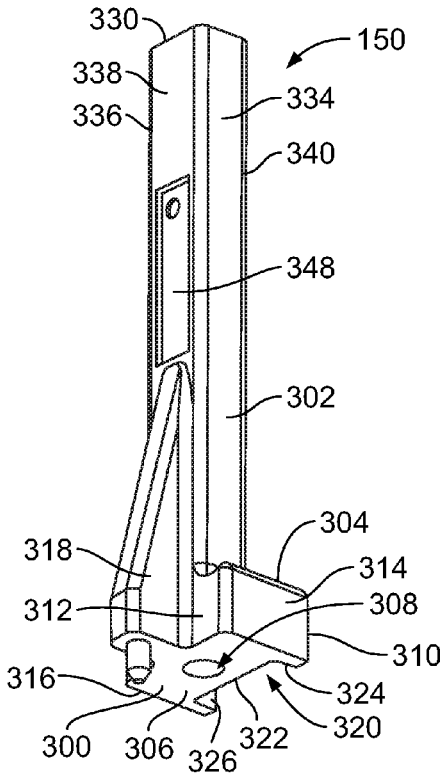
FIG. 3
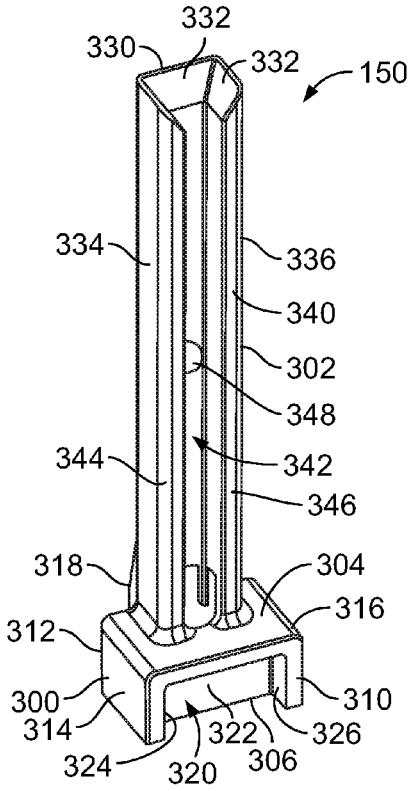
FIG. 4
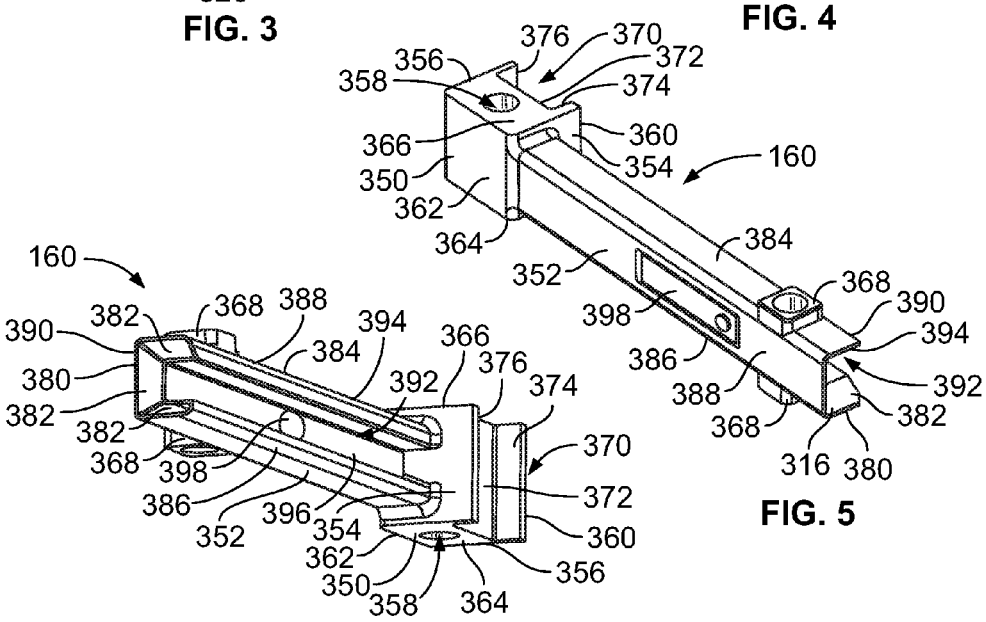
FIG. 5
FIG. 6

CARD-EDGE CONNECTOR ASSEMBLY HAVING CARD GUIDE MODULES

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge of a circuit card. The circuit card includes electrical components thereon, such as memory, processors and the like forming electrical circuits and interacting with the host circuit board. The card edge connectors are designed for supporting the stand-alone pluggable modules.

However, known card edge connectors are not without disadvantages. For instance, guidance of mating the circuit cards with the card edge connectors may be difficult. For example, the guidance may be performed by a guide module remote from the card edge connector. The guide module may have a dimensional relationship with a chassis or other structure that holds the host circuit board and the dimensional relationship may accumulate several tolerances in the stack-up of the components, leading to misalignment or the need for large gatherability, leading to larger components mounted on the host circuit board. Additionally, the card edge connectors may be subjected to stresses and strains during mating or when mated with the circuit card, which may damage or break the soldered connections between the contacts of the card edge connector and the host circuit board.

A need remains for a card edge connector assembly that may be mated with circuit cards in a reliable manner.

BRIEF DESCRIPTION OF THE INVENTION

In one embodiment, a card edge connector assembly is provided including a card edge connector having a housing defining a card slot configured to receive a circuit card. The housing holds contacts in the card slot to electrically connect to the circuit card. The contacts are configured to be electrically connected to a host circuit board. The housing has a base configured to be mounted to the host circuit board that extends between a first end and a second end and includes a first mounting lug having a first datum surface at the first end and a second mounting lug having a second datum surface at the second end. The card edge connector assembly includes a first card guide module coupled to the housing at the first end and a second card guide module coupled to the housing at the second end. The first card guide module has a base configured to be secured to the host circuit board including a first locating cavity that receives the first mounting lug and a first locating surface that engages the first datum surface to register the first card guide module relative to the housing. The first card guide module has a first support beam extending from the base having a first support surface configured to support a first end of the circuit card. The second card guide module has a base configured to be secured to the host circuit board including a second locating cavity that receives the second mounting lug and a second locating surface that engages the second datum surface to register the second card guide module relative to the housing. The second card guide module has a second support beam extending from the base having a second support surface configured to support a second end of the circuit card.

In another embodiment, a card edge connector assembly is provided including a circuit card having a card edge extending between a first end and a second end and having contact pads. The card edge connector includes a card edge connector having a housing defining a card slot configured to receive a circuit card. The housing holds contacts in the card slot to electrically connect to the circuit card. The contacts are configured to be electrically connected to a host circuit board. The housing has a base configured to be mounted to the host circuit board that extends between a first end and a second end and includes a first mounting lug having a first datum surface at the first end and a second mounting lug having a second datum surface at the second end. The card edge connector assembly includes a first card guide module coupled to the housing at the first end and a second card guide module coupled to the housing at the second end. The first card guide module has a base configured to be secured to the host circuit board including a first locating cavity that receives the first mounting lug and a first locating surface that engages the first datum surface to register the first card guide module relative to the housing. The first card guide module has a first support beam extending from the base having a first support surface configured to support a first end of the circuit card. The second card guide module has a base configured to be secured to the host circuit board including a second locating cavity that receives the second mounting lug and a second locating surface that engages the second datum surface to register the second card guide module relative to the housing. The second card guide module has a second support beam extending from the base having a second support surface configured to support a second end of the circuit card. The first and second support beams support the circuit card independent of the card edge connector.

BRIEF DESCRIPTION OF THE DRAWINGS

FIG. 3 is a bottom perspective view of a card guide module for the card edge connector assembly in accordance with an exemplary embodiment.

FIG. 4 is a perspective view of the card guide module in accordance with an exemplary embodiment.

FIG. 5 is a top perspective view of a card guide module for the card edge connector assembly in accordance with an exemplary embodiment.

FIG. 6 is a bottom perspective view of the card guide module in accordance with an exemplary embodiment.

DETAILED DESCRIPTION OF THE INVENTION

Figure 1:
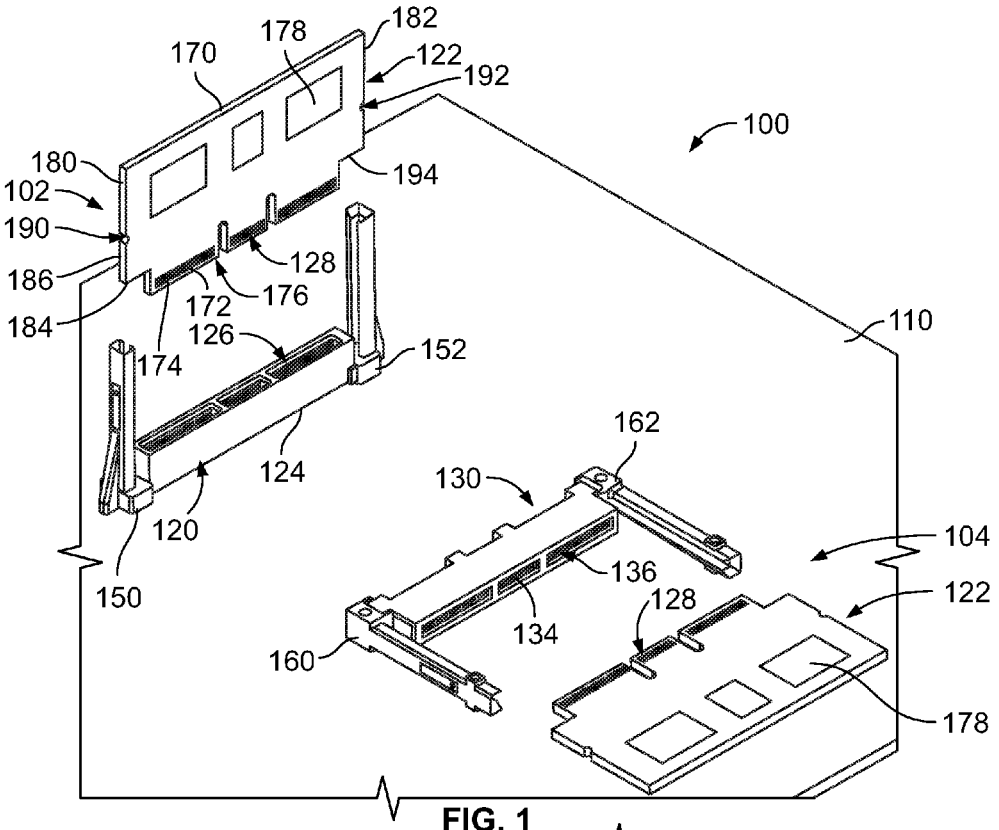
FIG. 1 is a perspective view of an electrical system showing various card edge connector assemblies in accordance with an exemplary embodiment showing the card edge connector assemblies in unmated positions.
Figure 2:
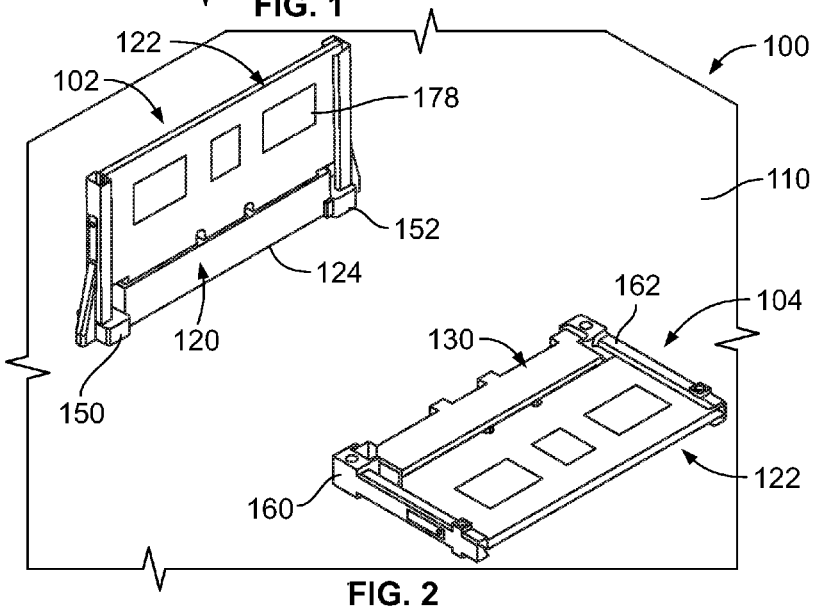
FIG. 2 is a perspective view of the electrical system showing the card edge connector assemblies in mated positions.

FIG. 1 is a perspective view of an electrical system 100 showing various card edge connector assemblies 102, 104 in accordance with an exemplary embodiment showing the card edge connector assemblies 102, 104 in unmated positions. FIG. 2 is a perspective view of the electrical system 100 showing the card edge connector assemblies 102, 104 in mated positions. The card edge connector assemblies 102, 104 are mounted to a host circuit board 110. While FIGS. 1 and 2 illustrate two different types of card edge connector assemblies having some similar components, it is realized that any number of any of the card edge connector assemblies 102, 104 may be utilized within the system 100. For example, in various embodiments, only one card edge connector assembly 102 or 104 may be used, only one type of card edge connector assembly 102 or 104 may be used with multiple of such card edge connector assembly 102, 104 mounted to the circuit board 110, or more than one type of card edge connector assemblies 102 and/or 104 may be mounted to the circuit board 110.

In the illustrated embodiment, the card edge connector assembly 102 is a vertical card edge connector assembly and the card edge connector assembly 104 is a right-angle or horizontal card edge connector assembly. Other types of card edge connector assemblies may be utilized in alternative embodiments. The card edge connector assemblies 102, 104 include similar components and like components may be identified using like names and like reference numbers. Not every card edge connector assembly 102, 104 is described herein in the same amount of detail and components described herein with reference to one of the card edge connector assemblies 102 or 104 may be applicable to other card edge connector assemblies 102 or 104.

The card edge connector assembly 102 includes a card edge connector 120 and a circuit card 122. The card edge connector 120 is configured to be mounted to the host circuit board 110, such as by soldering contacts 124 of the card edge connector 120 to the host circuit board 110. The card edge connector 120 has a mating end 126 configured to receive a mating end 128 of the circuit card 122. The mating end 126 is provided at a top of the card edge connector 120 to receive the circuit card 122 in a generally vertical mating direction, such as a mating direction perpendicular to the host circuit board 110.

The card edge connector assembly 104 includes a card edge connector 130 and the circuit card 122 (while the same circuit card 122 is illustrated in FIGS. 1 and 2, it is realized that the card edge connector assembly 104 may be configured to mate with a different type of circuit card, such as a cable circuit card having cables extending from the circuit card). The card edge connector 130 is configured to be mounted to the host circuit board 110, such as by soldering contacts 134 of the card edge connector 130 to the host circuit board 110. The card edge connector 130 has a mating end 136 configured to receive the mating end 128 of the circuit card 122. The mating end 136 is provided at a front of the card edge connector 130 to receive the circuit card 122 in a generally horizontal mating direction, such as a mating direction parallel to the host circuit board 110.

The card edge connector assembly 102 includes support members for the circuit card 122, such as first and second card guide modules 150, 152 configured to be mounted to the host circuit board 110 adjacent opposite ends of the card edge connector 120 to provide guidance and support for the circuit card 122. The card guide modules 150, 152 may be referred to as vertical card guide modules because the supporting portion of the card guide modules 150, 152 extends generally vertically. The card guide modules 150, 152 may alleviate stress or strain on the card edge connector 120 from the circuit card 122, such as from movement of the circuit card 122.

The card edge connector assembly 104 includes support members for the circuit card 122, such as first and second card guide modules 160, 162 configured to be mounted to the host circuit board 110 adjacent opposite ends of the card edge connector 120 to provide guidance and support for the circuit card 122. The card guide modules 160, 162 may be referred to as horizontal card guide modules because the supporting portion of the card guide modules 160, 162 extends generally horizontally. The card guide modules 160, 162 may alleviate stress or strain on the card edge connector 120 from the circuit card 122, such as from movement of the circuit card 122.

With reference to the card edge connector assembly 102 on FIG. 1, the circuit card 122 includes a substrate 170 having a card edge 172 at the mating end 128 configured to be loaded into the card edge connector 120 or 130. The circuit card 122 has a plurality of contact pads 174 at the card edge 172 configured to be electrically connected to the card edge connector 120 or 130. In an exemplary embodiment, the circuit card 122 includes one or more alignment slots 176 in the card edge 172 for locating the circuit card 122 within the card edge connector 120 or 130.

The circuit card 122 includes one or more electrical components 178 mounted to the circuit card 122. For example, the electrical components 178 may include a memory, a processor, or other types of electrical components. The electrical components 178 are electrically connected to corresponding contact pads 174. The circuit card 122 includes various circuits transmitting data and/or power between the contact pads 174 and the electrical components 178. In other various embodiments, the circuit card 122 may include a pluggable body, such as a housing, surrounding the circuit card 122 and/or the electrical components 178. The pluggable body may include one or more heat sinks for dissipating heat from the electrical components 178.

The circuit card 122 extends between a first end 180 and a second end 182. The circuit card has first and second sides 184, 186 between the first and second ends 180, 182. The electrical components 178 may be mounted to the first side 184 and/or the second side 186. The circuit card 122 includes latching feature 190, 192 at the first and second ends 180, 182 for securing the circuit card 122 in the card edge connector 120 or 130. In the illustrated embodiment, the latching features 190, 192 are pockets formed in the first and second ends 180, 182. Other types of latching features may be provided in alternative embodiments, such as deflectable latches, clips and the like. Optionally, the circuit card 122 may include shoulders 194 at the card edge 172. The shoulders 194 may define stop surfaces for loading the circuit card 122 into the card edge connector 120 or 130. In the illustrated embodiment, the shoulders 194 are provided adjacent the first and second ends 180, 182. Optionally, the alignment slots 176 may define the shoulders 194.

FIG. 3 is a bottom perspective view of the card guide module 150 in accordance with an exemplary embodiment. FIG. 4 is a perspective view of the card guide module 150 in accordance with an exemplary embodiment. Optionally, the first card guide module 150 may be identical to the second card guide module 152 (shown in FIG. 1) and thus features of the second card guide module 152 are described herein with reference to the first card guide module 150. For example, in an exemplary embodiment, the card guide modules 150, 152 are hermaphroditic and may be coupled to either end of the card edge connector 120 (shown in FIG. 1). Alternatively, rather than being identical, the components may be designed with a right-hand version and a left-hand version, which may be mirrored versions, for coupling to the opposite ends of the card edge connector 120.

The card guide module 150 includes a base 300 configured to be mounted to the host circuit board 110 (shown in FIG. 1) and a support beam 302 extending from the base 300. In an exemplary embodiment, the card guide module 150 is a vertical card guide module configured to extend vertically (for example, perpendicular to the host circuit board 110) and be coupled to the circuit card 122 in a vertical mating direction. The support beam 302 extends from a top 304 of the base 300. The top 304 is generally opposite a bottom 306 of the base 300, which is configured to be mounted to the host circuit board 110. In an exemplary embodiment, the bottom 306 includes a mounting feature 308 for mounting the base 300 to the host circuit board 110. In the illustrated embodiment, the mounting feature 308 is a threaded opening configured to receive mounting hardware, such as a fastener, such as a threaded screw. Other types of mounting features may be provided in alternative embodiments, such as a non-threaded opening, a post, a barb, a solder feature, and the like.

The base 300 includes an inner end 310 configured to face the card edge connector 120, an outer end 312 opposite the inner end 310, and opposite sides 314, 316 extending between the inner and outer ends 310, 312. The base 300 is generally box-shaped; however, the base 300 may have other shapes in alternative embodiments including other portions. In an exemplary embodiment, the support beam 302 extends from the base 300 at or near the inner end 310 and the mounting feature 308 is provided at the bottom 306 near the outer end 312. Optionally, the card guide module 150 has a support tab 318 extending from the base 300 and/or the support beam 302 for supporting the card guide module 150 on the host circuit board 110. The support tab 318 may include one of the mounting features 308, such as a post, an opening, and the like.

The base 300 includes a locating cavity 320 having one or more locating surfaces 322, 324, 326 configured to locate the card guide module 150 relative to the card edge connector 120. In an exemplary embodiment, the locating cavity 320 is provided at the inner end 310 and at the bottom 306. The locating cavity 320 is open at the inner end 310 and at the bottom 306 to receive a portion of the card edge connector 120. In the illustrated embodiment, the locating cavity 320 is generally rectangular in shape; however, the locating cavity 320 may have other shapes in alternative embodiments. In the illustrated embodiment, the locating cavity 320 includes an end locating surface 322, a first side locating surface 324 near the first side 314 and a second side locating surface 326 near the second side 316. The locating surfaces 322, 324, 326 are configured to engage the card edge connector 120 to register the location of the card guide module 150 relative to the card edge connector 120. The side locating surfaces 324, 326 may guide side-to-side positioning of the card guide module 150 relative to the card edge connector 120. The end locating surface 322 may guide end-to-end positioning of the card guide module 150 relative to the card edge connector 120.

The support beam 302 extends from the base 300 to a distal end 330. The support beam 302 is used to guide mating of the circuit card 122 to the card guide module 150. The support beam 302 supports the circuit card 122 to alleviate stresses and strains on the card edge connector 120, such as from movement of the circuit card 122 by transferring the stresses and strains to the base 300 and the host circuit board 110. In an exemplary embodiment, the support beam 302 includes a lead-in 332 at the distal end 330. The support beam 302 includes a first side 334, a second side 336, an outer end 338 and/or an inner end 340. In an exemplary embodiment, the support beam 302 includes a channel 342 defined by first and second rails 344, 346 at the first and second sides 334, 336. The channel 342 is open at the inner end 340 to receive the circuit card 122. The lead-in 332 guides the circuit card 122 into the channel 342. When the circuit card 122 is in the channel 342, the rails 344, 346 support opposite sides of the circuit card 122 for side-to-side positioning of the circuit card 122.

In an exemplary embodiment, the support beam 302 includes a latching feature 348 for securing the circuit card 122 to the card guide module 150. In the illustrated embodiment, the latching feature 348 is a deflectable latch coupled to the support beam 302, such as along the outer end 338. The latching feature 348 extends into the channel 342 to engage the circuit card 122 when the circuit card 122 is loaded into the channel 342, such as through an opening in the support beam 302 at the outer end 338. Other types of latching features may be provided in alternative embodiments, such as a pin, a slot, a clip, and the like. The latching feature 348 may be located at a different position on the support beam 302 in alternative embodiments.

FIG. 5 is a top perspective view of the card guide module 160 in accordance with an exemplary embodiment. FIG. 6 is a bottom perspective view of the card guide module 160 in accordance with an exemplary embodiment. Optionally, the first card guide module 160 may be identical to the second card guide module 162 (shown in FIG. 1) and thus features of the second card guide module 162 are described herein with reference to the first card guide module 160. For example, in an exemplary embodiment, the card guide modules 160, 162 are hermaphroditic and may be coupled to either end of the card edge connector 130 (shown in FIG. 1). Alternatively, rather than being identical, the components may be designed with a right-hand version and a left-hand version, which may be mirrored versions, for coupling to the opposite ends of the card edge connector 130.

The card guide module 160 includes a base 350 configured to be mounted to the host circuit board 110 (shown in FIG. 1) and a support beam 352 extending from the base 350. In an exemplary embodiment, the card guide module 160 is horizontal card guide module configured to extend horizontally (for example, parallel to the host circuit board 110) and be coupled to the circuit card 122 in a horizontal mating direction. The support beam 352 extends from a front 354 of the base 350. The front 354 is generally opposite a rear 356 of the base 350. The base 350 includes a bottom 364 configured to be mounted to the host circuit board 110 and a top 366 opposite the bottom 364. In an exemplary embodiment, the bottom 364 includes a mounting feature 358 for mounting the base 350 to the host circuit board 110. In the illustrated embodiment, the mounting feature 358 is a threaded opening configured to receive mounting hardware, such as a fastener, such as a threaded screw. Other types of mounting features may be provided in alternative embodiments, such as a non-threaded opening, a post, a barb, a solder feature, and the like. Optionally, the mounting features 358 may be provided at both the top and the bottom such that the card guide module 160 is hermaphroditic and can be coupled to the host circuit board 110 on either the right side or the left side of the card edge connector 130.

The base 350 includes an inner end 360 configured to face the card edge connector 130 and an outer end 362 opposite the inner end 360 that extends between the bottom 364 and the top 366. The base 350 is generally box-shaped; however, the base 350 may have other shapes in alternative embodiments including other portions. In an exemplary embodiment, the support beam 352 extends from the base 350 at or near the inner end 360 and the mounting feature 358 is provided at the bottom 364 near the outer end 362. In an exemplary embodiment, the card guide module 160 has a support tab 368 extending from the support beam 352 remote from the base 350. The support tab 368 is used to support the distal end of the support beam 352. For example, the support tab 368 is configured to rest on the host circuit board 110 and hold the support beam 352 in a generally horizontal orientation from the base 350 to the support tab 368. The support tab 368 may include one or more mounting features 358, such as threaded openings, posts, or other types of mounting features. Optionally, the support tab 368 is provided at both the top and the bottom such that the card guide module 160 is hermaphroditic and can be coupled to the host circuit board 110 on either the right side or the left side of the card edge connector 130.

The base 350 includes a locating cavity 370 having one or more locating surfaces 372, 374, 376 configured to locate the card guide module 160 relative to the card edge connector 130. In an exemplary embodiment, the locating cavity 370 is provided at the inner end 360 and at the bottom 364. The locating cavity 370 is open at the inner end 360 and at the bottom 364 to receive a portion of the card edge connector 130. Optionally, the locating cavity 370 may be open at the top 366. In the illustrated embodiment, the locating cavity 370 is generally rectangular in shape; however, the locating cavity 370 may have other shapes in alternative embodiments. In the illustrated embodiment, the locating cavity 370 includes an end locating surface 372, a first side locating surface 374 near the front 354 and a second side locating surface 376 near the rear 356. The locating surfaces 372, 374, 376 are configured to engage the card edge connector 130 to register the location of the card guide module 160 relative to the card edge connector 130. The side locating surfaces 374, 376 may guide side-to-side positioning of the card guide module 160 relative to the card edge connector 130. The end locating surface 372 may guide end-to-end positioning of the card guide module 160 relative to the card edge connector 130.

The support beam 352 extends from the base 350 to a distal end 380. The support tab 368 may be provided at or near the distal end 380. The support beam 352 is used to guide mating of the circuit card 122 to the card guide module 160. The support beam 352 supports the circuit card 122 to alleviate stresses and strains on the card edge connector 130, such as from movement of the circuit card 122 by transferring the stresses and strains to the base 350 and the host circuit board 110. In an exemplary embodiment, the support beam 352 includes a lead-in 382 at the distal end 380. The support beam 352 includes a first side 384, a second side 386, an outer end 388 and/or an inner end 390. In an exemplary embodiment, the support beam 352 includes a channel 392 defined by first and second rails 394, 396 at the first and second sides 384, 386. The channel 392 is open at the inner end 390 to receive the circuit card 122. The lead-in 382 guides the circuit card 122 into the channel 392. When the circuit card 122 is in the channel 392, the rails 394, 396 support opposite sides of the circuit card 122 for side-to-side positioning of the circuit card 122.

In an exemplary embodiment, the support beam 352 includes a latching feature 398 for securing the circuit card 122 to the card guide module 160. In the illustrated embodiment, the latching feature 398 is deflectable latch, which may be mounted to the outer end 388. A portion of the latching feature 398 may extend into the channel 392 to engage the circuit card 122. Other types of latching features may be provided in alternative embodiments. The latching feature 398 may be located at a different position on the support beam 352 in alternative embodiments.

Figure 7:
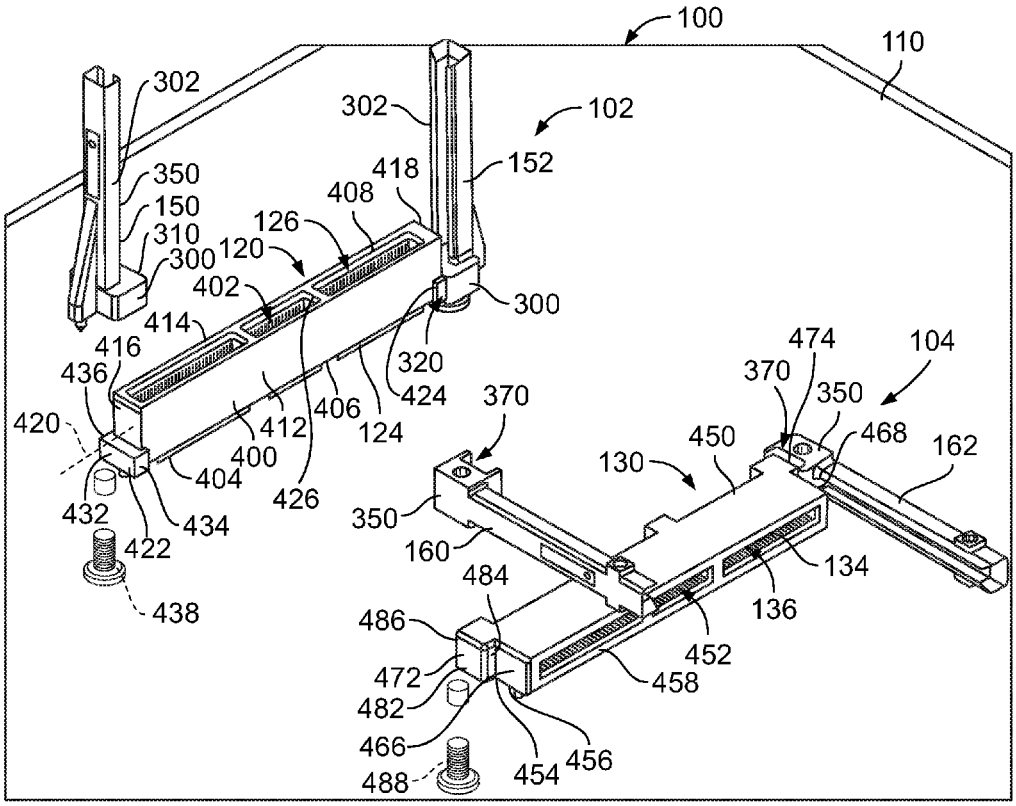
FIG. 7 is a perspective view of a portion of the electrical system showing the card edge connector assemblies.
Figure 8:
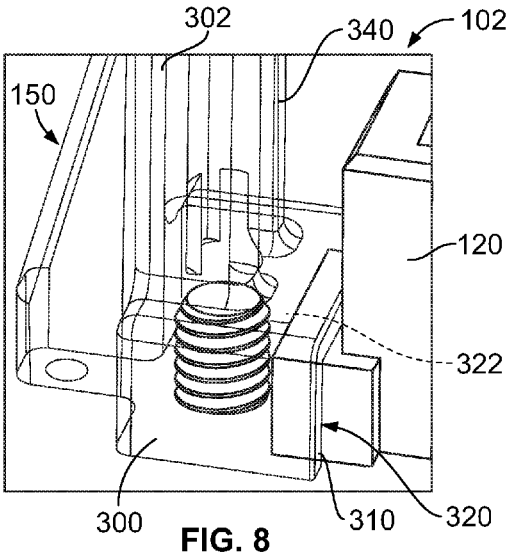
FIG. 8 is a perspective view of a portion of the card edge connector assembly showing the card guide module registered to the card edge connector.
Figure 9:
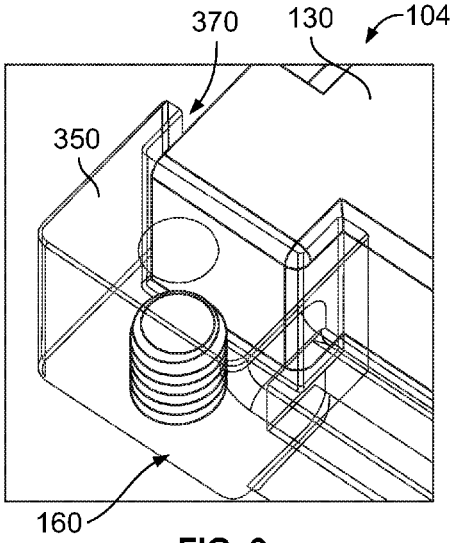
FIG. 9 is a perspective view of a portion of the card edge connector assembly showing the card guide module registered to the card edge connector.

FIG. 7 is a perspective view of a portion of the electrical system 100 showing the card edge connector assembly 102 and the card edge connector 104 partially mated to the host circuit board 110. FIG. 7 shows the card edge connectors 120, 130 mounted to the host circuit board 110. FIG. 7 shows the card guide modules 152, 162 coupled to the card edge connectors 120, 130, respectively. FIG. 7 shows the card guide modules 150, 160 poised for mounting to the card edge connectors 120, 130, respectively. FIG. 8 is a perspective view of a portion of the card edge connector assembly 102 showing the card guide module 150 registered to the card edge connector 120. FIG. 9 is a perspective view of a portion of the card edge connector assembly 104 showing the card guide module 160 registered to the card edge connector 130.

The card edge connector 120 includes a housing 400 defining a card slot 402 at the mating end 126 configured to receive the circuit card 122 (shown in FIG. 1). The housing 400 has a base 404 configured to be mounted to the host circuit board 110. In the illustrated embodiment, the base 404 is provided at a bottom 406 and the card slot 402 is provided at a top 408. The housing 400 holds a plurality of the contacts 124 in the card slot 402 to electrically connect to corresponding contact pads 174 of the circuit card 122. The contacts 124 are electrically connected to the host circuit board 110. For example, the contacts 124 may be soldered to the host circuit board 110. The housing 400 has a first side 412 and a second side 414 extending between a first end 416 and a second end 418. The card guide modules 150, 152 are coupled to the first and second ends 416, 418, respectively. The sides 412, 414 are elongated along a longitudinal axis 420 between the ends 416, 418. The ends 416, 418 extend laterally between the sides 412, 414.

In an exemplary embodiment, the card edge connector 120 includes a first mounting lug 422 at the first end 416 and a second mounting lug 424 at the second end 418. The card guide modules 150, 152 are configured to be coupled to the mounting lugs 422, 424. For example, the mounting lugs 422, 424 may be received in the locating cavities 320 of the card guide modules 150, 152, respectively. Optionally, the mounting lugs 422, 424 may be used to support the housing 400 on the host circuit board 110. For example, solder clips or solder tails may extend from the mounting lugs 422, 424 that are configured to be soldered to the host circuit board 110 to secure the housing 400 to the host circuit board 110.

Optionally, the housing 400 may include alignment ribs 426 extending across the card slot 402 between the sides 412, 414. The alignment ribs 426 are used to align the circuit card 122 in the card slot 402.

In an exemplary embodiment, the housing 400 includes one or more datum surfaces 432, 434, 436 for locating the card guide modules 150, 152 relative to the housing 400. For example, the mounting lugs 422, 424 may include datum surfaces. In the illustrated embodiment, each mounting lug 422, 424 includes an end datum surface 432, a first side datum surface 434 and a second side datum surface 436. The datum surfaces 432, 434, 436 are configured to engage the corresponding card guide modules 150, 152 to register the location of the card guide modules 150, 152 relative to the card edge connector 120. For example, the datum surfaces 432, 434, 436 register the location of the card guide modules 150, 152 relative to the mounting lugs 422, 424, respectively. The side datum surfaces 434, 436 may guide side-to-side positioning of the card guide modules 150, 152 relative to the card edge connector 120. The end datum surface 432 may guide end-to-end positioning of the card guide modules 150, 152 relative to the card edge connector 120.

Optionally, when the end datum surface 432 engages the end locating surface 322, a gap or space may be provided between the inner end 310 of the base 300 and/or the inner end 340 of the support beam 302 and the ends 416, 418 of the housing 400. As such, the ends 416, 418 do not block positioning of the card guide modules 150, 152 on the mounting lugs 422, 424. Optionally, the support beams 302 may be able to flex or move without engaging and causing stresses or strains to be transferred to the housing 400. Optionally, a space may be provided above the mounting lugs 422, 424 in the locating cavities 320 to allow the card guide modules 150, 152 to flex and move without engaging and causing stresses or strains to be transferred to the housing 400.

In an exemplary embodiment, mounting hardware 438, such as a threaded fastener, is used to secure the base 300 to the host circuit board 110. For example, the mounting hardware 438 may be loaded through the host circuit board 110 from below the host circuit board 110 to secure to the base 300 from below. The mounting hardware 438 may secure the base 300 to the host circuit board 110 such that stresses or strains induced in the card guide module 150 or 152 from the circuit card 122 are transferred to the host circuit board 110 through the mounting hardware 438.

In an exemplary embodiment, the mounting hardware 438 vertically fixes the base 300 to the host circuit board 110 such that the base 300 is unable to move vertically (for example, up and down, relative to the host circuit board 110). Optionally, the opening in the host circuit board 110 that receives the mounting hardware 438 may be oversized to allow the mounting hardware 438 to float or move laterally within the opening, such as to align with the mounting feature 308 of the card guide modules 150, 152. For example, the mounting hardware 438 and the base 300 may have a limited amount of floating movement relative to the host circuit board 110 in a horizontal plane parallel to the host circuit board 110 to allow the mounting hardware 438 to locate relative to the mounting feature 308 and/or to allow the base 300 to locate relative to the mounting lug 422, 424. As such, the card guide modules 150, 152 may be registered to the housing 400 of the card edge connector 120 at a designated support location as opposed to being located by the openings in the host circuit board 110. The housing 400 may have tighter tolerances than the openings in the host circuit board 110 for proper positioning of the card guide modules 150, 152 at the appropriate support locations and it may be beneficial to locate the card guide modules 150, 152 to the housing 400 rather than the host circuit board 110 via the openings. The relative positions of the card guide modules 150, 152 may be precisely controlled and registered to the housing 400 to ensure that the support beams 302 of the card guide modules 150, 152 are properly located for guiding and supporting the circuit card 122.

The card edge connector 130 includes a housing 450 defining a card slot 452 at the mating end 136 configured to receive the circuit card 122. The housing 450 has a base 454 configured to be mounted to the host circuit board 110. In the illustrated embodiment, the base 454 is provided at a bottom 456 and the card slot 452 is provided at a front 458. The housing 450 holds a plurality of the contacts 134 in the card slot 452 to electrically connect to corresponding contact pads 174 of the circuit card 122. The contacts 134 are right angle contacts extending generally horizontally at the mating end 136 and generally vertically at the bottom 456 to terminate to the host circuit board 110. The housing 450 extends between a first end 466 and a second end 468. The card guide modules 160, 162 are coupled to the first and second ends 466, 468, respectively.

In an exemplary embodiment, the card edge connector 130 includes a first mounting lug 472 at the first end 466 and a second mounting lug 474 at the second end 468. The card guide modules 160, 162 are configured to be coupled to the mounting lugs 472, 474. For example, the mounting lugs 472, 474 may be received in the locating cavities 370 of the card guide modules 160, 162, respectively.

In an exemplary embodiment, the housing 450 includes one or more datum surfaces 482, 484, 486 for locating the card guide modules 160, 162 relative to the housing 450. For example, the mounting lugs 472, 474 may include datum surfaces. In the illustrated embodiment, each mounting lug 472, 474 includes an end datum surface 482, a first side datum surface 484 and a second side datum surface 486. The datum surfaces 482, 484, 486 are configured to engage the corresponding card guide modules 160, 162 to register the location of the card guide modules 160, 162 relative to the card edge connector 130. For example, the datum surfaces 482, 484, 486 register the location of the card guide modules 160, 162 relative to the mounting lugs 472, 474, respectively. The side datum surfaces 484, 486 may guide side-to-side positioning of the card guide modules 160, 162 relative to the card edge connector 130. The end datum surface 482 may guide end-to-end positioning of the card guide modules 160, 162 relative to the card edge connector 130.

In an exemplary embodiment, mounting hardware 488, such as a threaded fastener, is used to secure the base 350 to the host circuit board 110. For example, the mounting hardware 488 may be loaded through the host circuit board 110 from below the host circuit board 110 to secure to the base 350 from below. The mounting hardware 488 may secure the base 350 to the host circuit board 110 such that stresses or strains induced in the card guide module 160 or 162 from the circuit card 122 are transferred to the host circuit board 110 through the mounting hardware 488.

Figure 10:
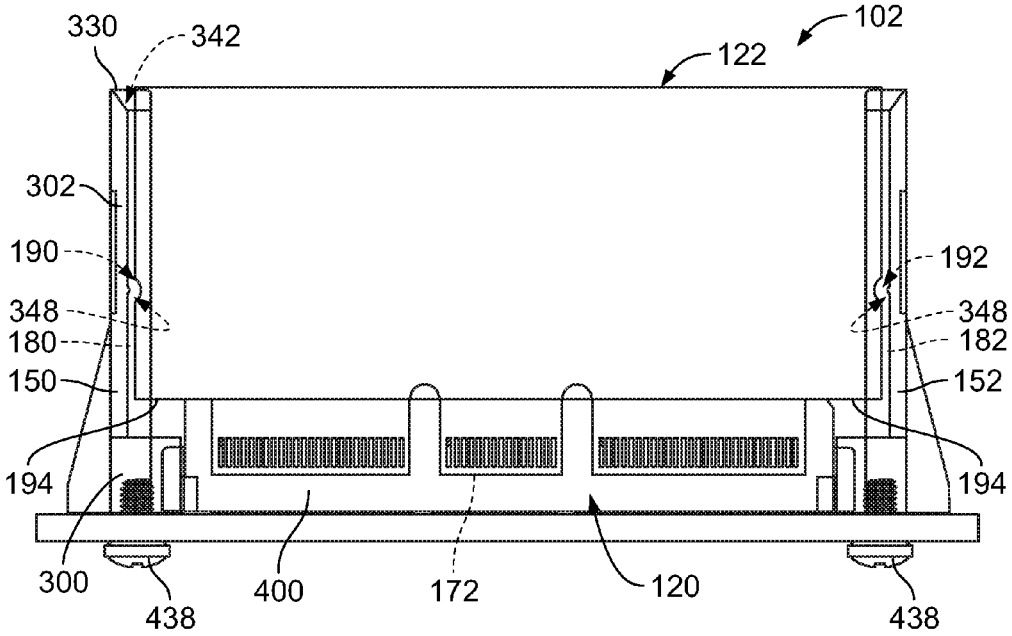
FIG. 10 is a side view of the card edge connector assembly showing a circuit card mated with the card guide modules and the card edge connector.
Figure 11:
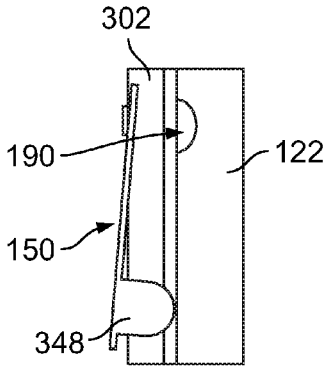
FIG. 11 is a partial sectional view of a portion of the card edge connector assembly showing the circuit card partially mated to the card guide modules.
Figure 12:
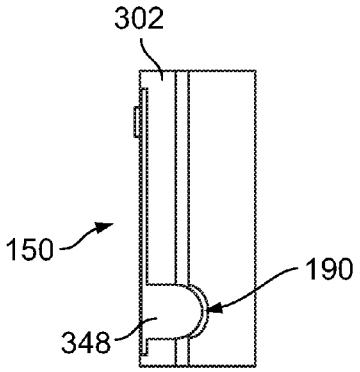
FIG. 12 is a partial sectional view of a portion of the card edge connector assembly showing the circuit card fully mated to the card guide modules.

FIG. 10 is a side view of the card edge connector assembly 102 showing the circuit card 122 mated with the card guide modules 150, 152 and the card edge connector 120. FIG. 11 is a partial sectional view of a portion of the card edge connector assembly 102 showing the circuit card 122 partially mated to the card guide modules 150, 152. FIG. 12 is a partial sectional view of a portion of the card edge connector assembly 102 showing the circuit card 122 fully mated to the card guide modules 150, 152.

During mating, the circuit card 122 is loaded into the channels 342 in the support beams 302 of the card guide modules 150, 152. For example, the first and second ends 180, 182 are guided into the channels 342 by the lead-ins 332 at the distal ends support beams 302. During mating, the support beams 302 guide mating of the circuit card 122 with the card edge connector 120. For example, the support beams 302 locate the circuit card 122 above the card edge connector 120 in proper alignment with the card slot 402. The card guide modules 150, 152 are registered to the housing 400 of the card edge connector 120 to align the circuit card 122 with the card edge connector 120. The lead-ins 332 at the distal ends 330 of the support beams 302 guide the circuit card 122 into the card slot 402 of the card edge connector 120. For example, as the circuit card 122 is lowered in the mating direction toward the card edge connector 120, the card edge 172 of the circuit card 122 is eventually received in the card slot 402.

The circuit card 122 is loaded until the latching features 190, 192 interface with the latching features 348 (FIG. 12). For example, the latching features 348 may be spring loaded into the cutouts defining the latching features 190, 192 to secure the circuit card 122 in position relative to the card guide modules 150, 152. Optionally, the circuit card 122 may be mated until the shoulders 194 of the circuit card 122 are seated against the housing 400. However, rather than engaging the housing 400, in various embodiments, the shoulders 194 may be spaced apart from the housing 400 in the fully loaded position.

When mated, movement of the circuit card 122, such as from vibration, is transferred to the card guide modules 150, 152. The forces from the movement are transferred to the support beams 302 into the bases 300 and to the host circuit board 110 through the mounting hardware 438. The forces largely bypass the card edge connector 120 such that stresses and strains to the card edge connector 120 are minimal. The support beams 302 provide mechanical support at a location remote from the card edge connector 120 such as a vertical distance above the card edge connector 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a card edge connector having a housing defining a card slot configured to receive a circuit card, the housing holding contacts in the card slot to electrically connect to the circuit card, the contacts being configured to be electrically connected to a host circuit board, the housing having a base configured to be mounted to the host circuit board, the base extends between a first end and a second end and includes a first mounting lug having a first datum surface at the first end and a second mounting lug having a second datum surface at the second end;

a first card guide module coupled to the housing at the first end, the first card guide module having a base configured to be secured to the host circuit board, the base including a first locating cavity having a first locating surface, the first locating cavity receiving the first mounting lug, the first locating surface engaging the first datum surface to register the first card guide module relative to the housing, the first card guide module having a first support beam extending from the base having a first rail configured to support a first end of the circuit card; and a second card guide module coupled to the housing at the second end, the second card guide module having a base configured to be secured to the host circuit board, the base including a second locating cavity having a second locating surface, the second locating cavity receiving the second mounting lug, the second locating surface engaging the second datum surface to register the second card guide module relative to the housing, the second card guide module having a second support beam extending from the base having a second rail configured to support a second end of the circuit card.

2. The card edge connector assembly of claim 1, wherein the first and second card guide modules register a position of the circuit card relative to the card edge connector and support the circuit card to hold the circuit card relative to the contacts.

3. The card edge connector assembly of claim 1, wherein the first and second card guide modules are registered relative to the host circuit board by the first and second locating surfaces engaging the first and second datum surfaces, respectively.

4. The card edge connector assembly of claim 1, wherein the base of the first card guide module and the base of the second card guide module are secured to the host circuit board by mounting hardware independent of the card edge connector.

5. The card edge connector assembly of claim 1, wherein the base of the first card guide module is secured to the host circuit board by mounting hardware such that the mounting hardware and the base have a limited amount of floating movement relative to the host circuit board in a horizontal plane parallel to the host circuit board to allow the base to locate relative to the first mounting lug, the mounting hardware being configured to fix the base of the first card guide module in a vertical direction perpendicular to the host circuit board.

6. The card edge connector assembly of claim 1, wherein the first datum surface includes an end datum surface and a side datum surface perpendicular to the end datum surface, and wherein the first locating surface of the first card guide module includes an end locating surface and a side locating surface perpendicular to the end locating surface, the end locating surface engaging the end datum surface and the side locating surface engaging the side datum surface to register the first card guide module to the housing in two perpendicular directions.

7. The card edge connector assembly of claim 6, wherein the datum surface further comprises a second side datum surface and the card guide module further comprising a second side locating surface engaging the second side datum surface to register the first card guide module to the housing.

8. The card edge connector assembly of claim 1, wherein the first card guide module includes a support tab extending from the support beam configured to engage the host circuit board independent of the base.

9. The card edge connector assembly of claim 1, wherein the first support beam extends vertically above the base of the first card guide module to receive the circuit card in a mating direction perpendicular to the host circuit board.

10. The card edge connector assembly of claim 1, wherein the first support beam extends from the base of the first card guide module generally parallel to the host circuit board.

11. The card edge connector assembly of claim 1, wherein the first card guide module includes a first channel defined by rails, the first channel receiving the first end of the circuit card with the rails supporting first and second opposite sides of the circuit card.

12. The card edge connector assembly of claim 1, wherein the first support beam includes a latching feature configured to latchably secure the circuit card to the first card guide module.

13. The card edge connector assembly of claim 1, wherein the first card guide module and the second card guide module are identical.

14. A card edge connector assembly comprising:

a circuit card having a card edge extending between a first end and a second end, the card edge having contact pads;

a card edge connector having a housing defining a card slot receiving the card edge of the circuit card, the housing holding contacts in the card slot to electrically connect to corresponding contact pads of the circuit card, the contacts being configured to be electrically connected to a host circuit board, the housing having a base configured to be mounted to the host circuit board, the base extends between a first end and a second end and includes a first mounting lug having a first datum surface at the first end and a second mounting lug having a second datum surface at the second end;

a first card guide module coupled to the housing at the first end, the first card guide module having a base configured to be secured to the host circuit board, the base including a first locating cavity having a first locating surface, the first locating cavity receiving the first mounting lug, the first locating surface engaging the first datum surface to register the first card guide module relative to the housing, the first card guide module having a first support beam extending from the base having a first support surface configured to support the first end of the circuit card; and a second card guide module coupled to the housing at the second end, the second card guide module having a base configured to be secured to the host circuit board, the base including a second locating cavity having a second locating surface, the second locating cavity receiving the second mounting lug, the second locating surface engaging the second datum surface to register the second card guide module relative to the housing, the second card guide module having a second support beam extending from the base having a second support surface configured to support the second end of the circuit card;

wherein the first and second support beams support the circuit card independent of the card edge connector.

15. The card edge connector assembly of claim 14, wherein the circuit card includes a first latching feature at the first end latchably coupled to a first latching feature of the first card guide module and a second latching feature at the second end latchably coupled to a second latching feature of the second card guide module.

16. The card edge connector assembly of claim 14, wherein the first card guide module and the second card guide module are positioned to have a tighter tolerance than the card edge connector for locating the pluggable module.

17. The card edge connector assembly of claim 14, wherein the first and second card guide modules register a position of the circuit card relative to the card edge connector and support the circuit card to hold the circuit card relative to the contacts.

18. The card edge connector assembly of claim 14, wherein the first and second card guide modules are registered relative to the host circuit board by the first and second locating surfaces engaging the first and second datum surfaces, respectively.

19. The card edge connector assembly of claim 14, wherein the base of the first card guide module is secured to the host circuit board by mounting hardware such that the mounting hardware and the base have a limited amount of floating movement relative to the host circuit board in a horizontal plane parallel to the host circuit board to allow the base to locate relative to the first mounting lug, the mounting hardware being configured to fix the base of the first card guide module in a vertical direction perpendicular to the host circuit board.

20. The card edge connector assembly of claim 14, wherein the first datum surface includes an end datum surface and a side datum surface perpendicular to the end datum surface, and wherein the first locating surface of the first card guide module includes an end locating surface and a side locating surface perpendicular to the end locating surface, the end locating surface engaging the end datum surface and the side locating surface engaging the side datum surface to register the first card guide module to the housing in two perpendicular directions.

* * * * *